US005113734A

United States Patent [19]

Mahler

[11] Patent Number: 5,113,734

[45] Date of Patent: May 19, 1992

[54] STRAIGHT EDGE RIPPING GUIDE FOR BOARDS WITH TWO UNEVEN EDGES

[76] Inventor: Edward H. Mahler, P.O. Box 137, Harding Rd., Round Pond, Me. 04564

[21] Appl. No.: 621,742

[22] Filed: Dec. 3, 1990

[51] Int. Cl.[5] ..... B27B 25/10

[52] U.S. Cl. ..... 83/409; 83/435.1; 83/437; 144/376

[58] Field of Search ..... 83/435.1, 423, 425, 83/437, 451, 467.1, 468, 468.7, 477.2, 409, 415; 144/376; 269/56, 58

[56] References Cited

U.S. PATENT DOCUMENTS

| | | | |
|---|---|---|---|
| 3,286,744 | 11/1966 | Stall et al. | 83/409 |
| 4,155,283 | 5/1979 | Mericle | 83/409 |
| 4,164,882 | 8/1979 | Mericle | 83/409 |
| 4,612,966 | 9/1986 | Jenkner | 83/435.1 X |
| 4,688,614 | 8/1987 | Jenkner | 83/435.1 X |
| 4,895,059 | 1/1990 | Peterson et al. | 83/468.7 |

*Primary Examiner*—Frank T. Yost
*Assistant Examiner*—Eugenia A. Jones
*Attorney, Agent, or Firm*—Laforest S. Saulsbury

[57] ABSTRACT

A straight edge ripping guide for use in removing one curved and uneven edge of a board having two uneven edges. The double uneven edge board is assembled to the ripping guide that has longitudinally adjustable projections to contact the high points of the uneven edge opposite to the uneven edge that is to be first cut. With the leading end of the board engaging a laterally-extending push stop of the guide, the board and guide are pushed together along the table saw fence to straighten and square the uneven side edge. Pin points are provided on the push stop and one of the projections to hold the board against lateral and upward displacement from the guide. The high point projections are adjustably retained in a continuous dovetail groove. There are main and extension guide pieces that are detachably connected together by elongated square-section blocks fitted into the end of the square hollow openings running through the guide pieces. The laterally-extending push stop is similarly connected by a square-section shank fitted in the leading end of the main guide piece. Spring latch pins on the guide pieces enter holes in the blocks and shank to hold the pieces and push stop against longitudinal displacement from one another.

7 Claims, 2 Drawing Sheets 36
34
26
21'
26
26
32
15
22'
23"
26
22
35"
35
26
27
26
28'
28
28'
26
27
24
21'
24'
24'
28
22

32
35'
27
26
28'
28
8
35"
24
35
36
31
8
23

23
23"
32
35
35"
38
36
37'
37
39

24'
24'

24
27
26
28'
28
28
26
27
24'
28'
35"
35
26
24
32
21'
24'
22
22"

STRAIGHT EDGE RIPPING GUIDE FOR BOARDS WITH TWO UNEVEN EDGES

This invention relates to a straight edge ripping guide for use with a table saw for boards having two visible uneven side edges to straighten and square.

When working rough sawn lumber, two uneven edges of the lumber piece or board have to be cut, straightened and squared to provide finished joinable boards. With one edge of a board being already straightened, there is no problem to cut the other uneven edge, as the already cut edge is simply run along the fence of the table saw. The problem for the worker has been with boards that are uneven on both edges and one edge has to be ripped straight and squared before the other edge can be straightened and squared. Generally, the operation has been done by nailing a straight edge piece upon one uneven side edge of the board so as to overhang the uneven edge and used as the guide against the table saw fence to cut straight and square the other uneven edge and from which the remaining uneven edge will be cut straightened and squared on removal of the nailed on straight edge from the first cut edge.

Time for nailing on the guide slows down production when a large number of two visible uneven side edge boards are to be straightened. The woodworker has to prepare the temporary guide piece, nail it in place upon the work piece, cut the uneven edge of the work piece, remove the guide and mend the nail holes. This procedure has to be followed with each board. The alternative has been to merely cut from an uneven edge placed against the fence of the table saw. In this way, the tendency is to leave the edge crooked with a curve in it, and need for another pass of the board and/or straightening/smoothing operation on a jointer tool.

It is the principal object of the present invention to provide a satisfactory ripping guide for boards with two uneven edges that need to be cut, squared and straightened to increase volume processing of two uneven edged boards on table saws and one that can be extended for different length uneven-edged boards.

It is another object of the invention to provide a straight edge rip guide for use on a table saw for two curved, crooked and uneven edge boards that will eliminate a jointed operation and yet provide smooth, straight joinable stock for use in construction.

It is still another object of the invention to provide a straight edge ripping guide for use on a table saw for two curved and uneven-edged boards in which the lateral contacting head projections of the guide for an uneven edge of the board are adjustable along a continuous dovetail groove in the side of the guide to locate and contact high points of the curved uneven edge of the board for proper engagement of the uneven edge with the guide.

Further objects of the invention are to provide a ripping guide for two crooked, uneven-edged boards, having the above objects in mind, that has a minimum number of parts, is inexpensive to manufacture, simple in construction, easy to assemble and operate, light in weight, of pleasing appearance, effective and efficient to use.

GENERAL DESCRIPTION

Generally, the present guide includes one long beam some thirty-six inches in length and two extra extensions of some thirty and twenty-four inches in length for use with the long boards. The beam and extensions are preferably made of hollow extruded lightweight metal or plastic. All pieces have dovetail matching grooves running along the full length of one of their sides and in which projection assemblies for contact with high points of an uneven board edge are adjustable and secured by dovetail nuts within the grooves.

The beam and extension pieces are joined together by square section connecting blocks fitted into the ends of square hollow openings running through the pieces and retained by spring latches carried by the guide pieces and having holes in the blocks to receive latch pins of spring latches and thereby to hold the guide pieces against longitudinal displacement from one another.

A dovetail-shaped nut is provided with each projection assembly that is worked along the dovetail groove to engage the high points on the curved, crooked side edge of the board. Each projection assembly includes a headed screw that is tightened into the dovetail nut to hold the assembly in position in the groove. On the lead end of the main beam is a push stop that extends at right angles therefrom and against which the end of the board to be trimmed, ripped, straightened and squared is thrust so that the guide is moved along with the board as it is advanced for the sawing operation. The two headed screws that extend from the dovetail nuts serve as the two projection points by which a straight line is created and since the back edge of the beam and extensions are straight parallel to the grooved straight front edge that engages the table fence a straight cut corresponding to the straight line created between the heads of the dovetail nut retained screws the one uneven edge of the board is given a straight, initial first cut with the use of the ripping guide. To cut the remaining edge, the straightened and squared initial cut side of the board is run directly against the table saw fence without the cutting guide to provide the finished joinable board.

DETAILED DESCRIPTION

For a better understanding of the invention, reference may be made to the following detailed description taken in connection with the accompanying drawing, in which, FIG. 1 is a top perspective view of a table saw and ripping guide with an illustration of the same being used to cut the one uneven side edge of a board while being guided by the other uneven side edge and guide.

Figure 1:
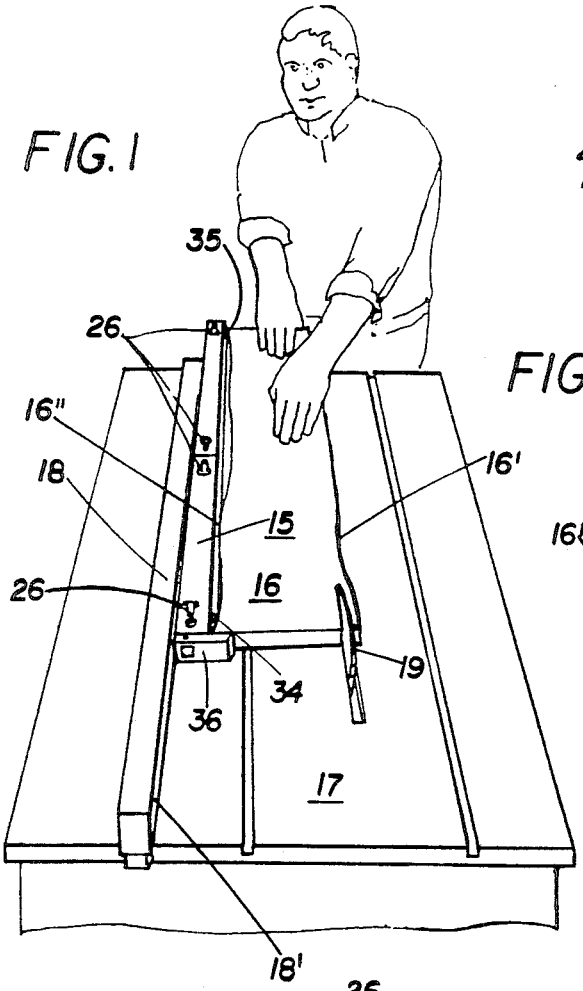
Figure 2:
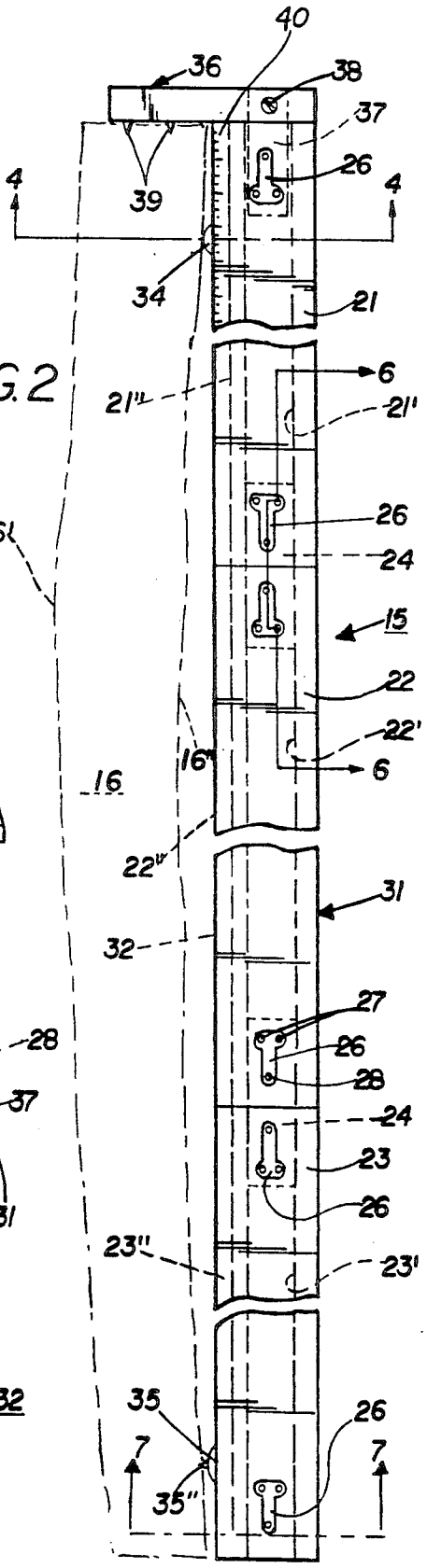
FIG. 2 is an enlarged fragmentary top plane view of the ripping guide including the two extensions with portions of the beam and extensions being broken away.

Referring now to the Figures, the true straight ripping guide assembly as indicated generally at 15 and in FIGS. 1 and 2 illustration is made as to how a board 16 with two crooked, uneven side edges 16' and 16'' is placed in the guide 15 for the one edge 16' that has to be straightened and squared before the other edge 16'' can be so done from the squared one edge. Such ripping is done on a rotary table saw 17 having a guide fence 18 and a rotary saw blade 19. The board 16 is simply assembled to the ripping guide 15 and the assembly board and guide is placed against the table saw fence 18 and together they are pushed along the saw blade 19 so that the one uneven edge 16' is straightened and squared. This is all accomplished without extensive setup time. The need for nailing a straight edge guide upon the uneven edge 16'' of the board 16 has been eliminated. This ripping guide 15 when used thereby increases volume production.

Figures 3, 6, 7, 8, 9, 10, 11:
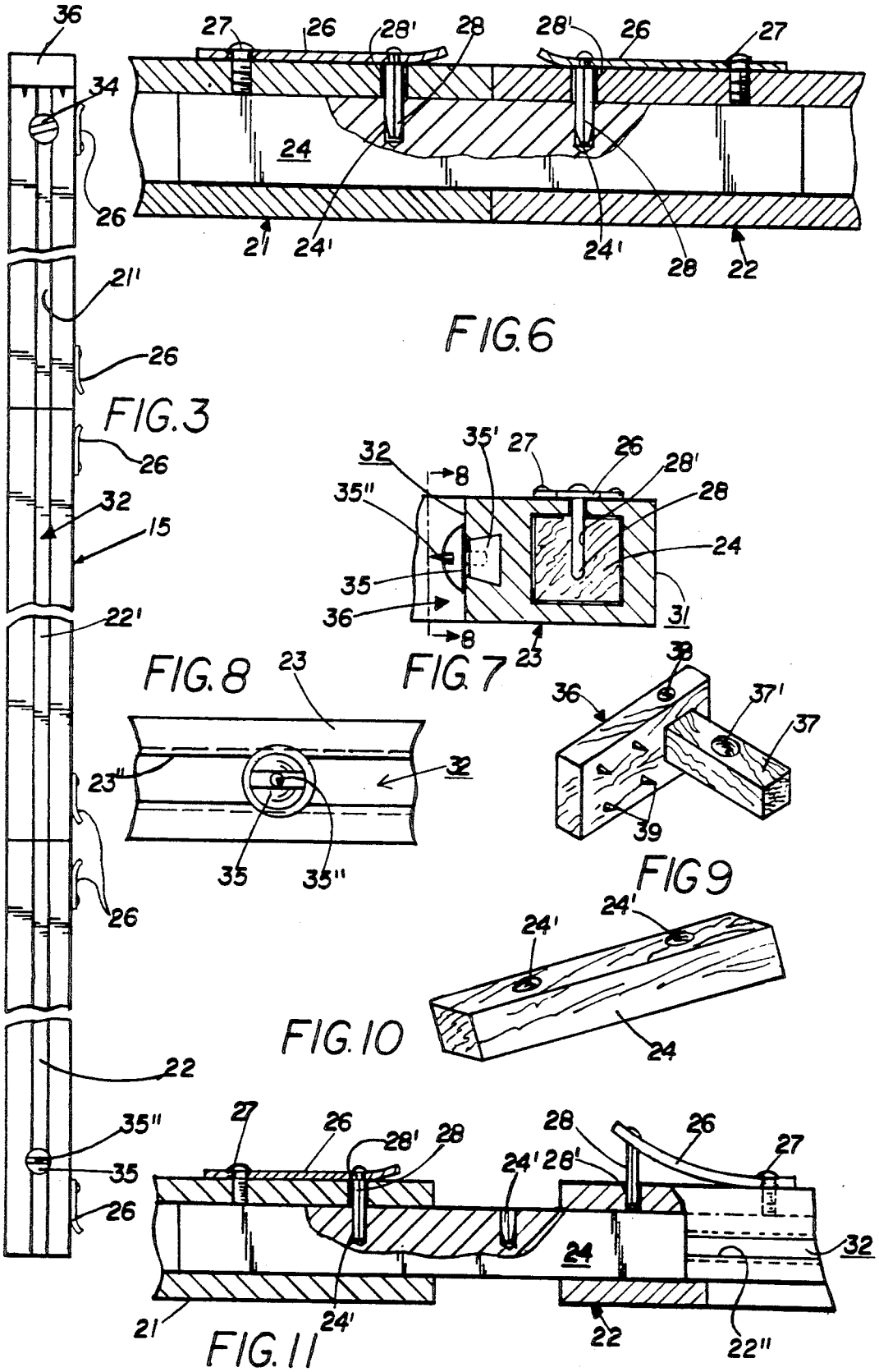
FIG. 3 is an elevational view of the dovetail face of the guide beam and its two extensions also with portions broken away.
FIG. 6 is an enlarged fragmentary longitudinal sectional view taken of the block connection of the beam and first extension and as viewed on line 6—6 of FIG. 2.
FIG. 7 is a transverse sectional view looking upon the pinpointed projection at the trailing end of the assembled guide beam extension as generally viewed on line 7—7 of FIG. 2.
FIG. 8 is a fragmentary elevational view taken on line 8—8 of FIG. 7 and looking in plan upon the pinpointed projection assembly.
FIG. 9 is a perspective view of the pinpointed transverse push stop removed from the forward end of the guide assembly.
FIG. 10 is a perspective view of one of the elongated attaching blocks for assembling the guide pieces together removed and shown free of the guide.
FIG. 11 is an enlarged fragmentary longitudinally-extending view similar to FIG. 6 and illustrating the manner in which the guide beam and pieces are assembled to one another by use of the elongated attaching block and the spring pin latches.

The assembled ripping guide 15 is made up of a main beam 21 that runs some thirty-six inches in length and to which extensions 22 and 23 of less length may be added to the end of the main beam 21 and to one another. The beam and extensions are hollowed from extrusion so as to respectively provide square holes 21', 22' and 23' that extend fully therethrough. These pieces are assembled together with the use of elongated attaching blocks 24 such as shown detached in FIG. 10. The block 24 is extended halfway its length into the end of the beam or extension and the other piece is extended over the other half length in a manner that can be seen best in FIGS. 6 and 11. Through spring latches 26 of T-shape in plan that are fixed to the top face of the guide pieces by guide screws 27 and have latch pins 28 that on extending through hole 28' in the guide pieces enter holes 24' in the block 24, whereby the pieces on being drawn together in abutting relationship are thereby held against longitudinal and twisting displacement by virtue of the block square section in the square holes of the pieces. The corresponding side faces of the pieces and the square holes therein are all longitudinally-aligned with one another. A continuous smooth side face 31 is thereby provided that engages a corresponding straight continuous side face 18' of the table saw fence 18 by which the assembly is guided as the present guide 15 and board 16 are pushed over the table 17 for ripping off the uneven side edge 16' thereby to straighten and square the edge in the one operation rather than to be left uneven as a result of ripping from the other uneven side edge used along against the saw fence 18.

On the side of the pieces opposite to the straight faces 31 are continuous dovetail grooves 21'', 22'' and 23'' of all the pieces 21, 22 and 23 that provide on continuous groove 32 when pieces are all joined together. This groove 32 slidably accommodates a forward headed screw 34 and nut 34' that forms the forward projection assembly against which the high point of the forward end of the board 16 is placed and a headed screw 35 and nut 35' that forms the rear projection assembly against which uneven edge 16'' at the trailing end of the board 16 is placed. To give protection against rearward slipping and upward displacement of the board 16 from the guide 15 on the board being sawed, a pinpoint 35'' is extended from the head of screw 35 to penetrate the board edge at its rear high point, see FIGS. 2, 3, 7 and 8. These screw and nut projection assemblies thereby provide the projections for engagement with the high points of board 16.

Figure 4:
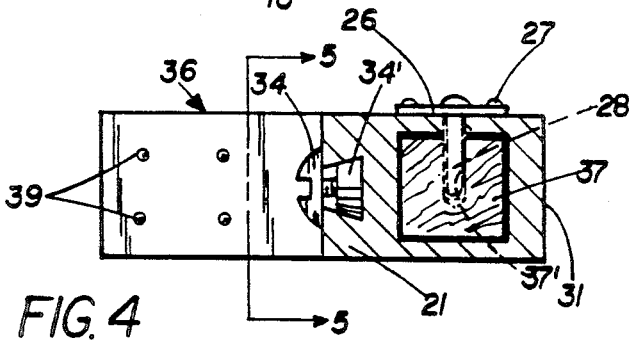
FIG. 4 is an enlarged transverse sectional view taken on line 4—4 of FIG. 2 and looking upon the pinpoint inner face of the detachable push stop attaching block that is carried on the leading end of the guide beam.
Figure 5:
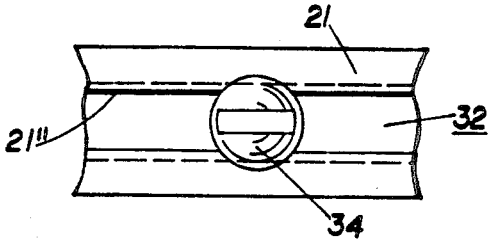
FIG. 5 is an enlarged fragmentary elevational view looking generally upon the dovetail side face of the guide and the one headed screw projection assembly at the forward end of the guide beams adjacent to the push stop at the leading end of the guide, as viewed on line 5—5 of FIG. 4.

Forward end of the guide 15 is provided with a laterally-extending push stop member 36 removably retained in the beam 21 by a square section block shank extension 37 held by a screw 38 on the member 36 and slide fitted into the end of square hole 21' of the beam 21. It is removably retained in the hole 21' by a spring latch 26, described above, so that its latch pin 28 will enter a hole 37' in the block shank extension 37, FIGS. 2, 4 and 9. Extending from the rear face of the laterally-extending stop member 36 are four pin points 39 against which the forward end of the board 16 is thrust and thereby retained against outward and upward displacement from the guide 15 and the table saw 17 upon the board 16 being pushed into the rotary saw blade 19 in the manner illustrated in FIG. 1. With these pin points 39 serving this purpose, there is no need of the screw 34 and dovetail nut 34' assembly to have a pin point as they are in the dovetail groove so close to the pins 39 at stop member 36. Such pin point would interfere with the placement of the end of the board against the pins 39 of the push stop 36. The pin point 35'' of the rear screw 35 and dovetail nut 35' projections assembly will prevent upward displacement of the board from guide 15 distant from the pin pointed push stop 36 as the guide and board are passed over the saw table. Both of these screw and nut projection assemblies, upon their screws being released, are adjustable along the full dovetail groove 32 to be located at the high points of the curved uneven edge 16'' at the respective leading and trailing ends of the board 16. The spring latches 26 are turned up from their free ends to facilitate the grasping and lifting of their pins 28 from the corresponding holes 24' and 37' in the block 24 and shank 37 to facilitate the separation and union of the guide pieces from and to one another.

The number of the guide extensions to be used will be determined from the length of boards to be ripped or cut. For short boards up to 36 inches, the main guide piece 21 need only be used and the extensions will be added as shown to the main beam for the longer boards. The same sized elongated blocks 24 are common to the connection of the guide pieces to one another. The lateral stop member 36 at the forward end of the guide 15 has its own attaching block 37 that can be fitted into any of the hollow ends of the several guide pieces including the extensions and will be retained by the same type spring latch pins 26 as are used throughout the assembly. With two or more guide piece assembly, the dovetail groove will be continuous but in either assembly only two high point screw and dovetail nut assemblies projection need to be used, one at the leading end of the ripping guide 15 and the pin pointed one to the rear of the assembled guide. The screw and dovetail nut assemblies are adjustable to any location along the continuous dovetail groove 32 for the best adaptation to the particular uneven board side edge 16". The screw and dovetail nut assemblies will be fixed in-place for the best high point contact with the uneven edge 16" of the board. The two dovetail assemblies will ordinarily be on the beam 21 itself for the short length boards, but with the added guide extensions, the pin-pointed screw 35 and dovetail nut 35' assembly at the rear of the guide will be adjusted ordinarily throughout the extensions to the end of the full assembled guide. The lead end of the main beam 21 will carry the push stop member 36 but it can be removed and inserted in the square hollow opening in the end of an extension and held by its spring latch 26.

The purpose of the two headed screw and nut assemblies is to provide two relative points from which straight line is created from one crest or high point to another upon the word board 16. Since the back edge face of the beam and extensions are perfectly straight and parallel to the front dovetail edge face, a straight line is thereby transferred to the imaginary straight line existing between the crests or high points of its screw and dovetail nut assemblies on the dovetail front face of the guide. The two end crests or high points of a curved or crooked board edge 16" are bridged so that the gap therebetween in effect transfers the back edge straight line to the board and a straightened and new squared edge is produced. The four pins on the lateral push stop 36 and the pin point 35" on the rear screw and nut assembly retain the board against lateral and upward displacement along the work piece from the guide 15.

In use, the board 16 is fixed to the assembled straight ripping guide 15 when the board with its high points are placed against the leading screw and nut assembly that has no pin and the end of the board forced onto pin points 39 of the push stp 36. The other screw 35 and nut 35' assembly is used more remote from the push stp 36 engages the other high point of the board edge 16". The board and the guide are then pushed along the fence 18 of the table saw 17, and a straight cut is made upon the edge 16' of the board. Both the front and rear screw and nut assemblies stabilize the board upon the guide to provide a unit such that but a minimum amount of slab need to be taken from the first cut uneven edge 16' of the board 16.

Measuring tapes 40 respectively are adhered along the top face of the respective guide pieces 21, 22 ad 23 and adjacent to the dovetail sides thereof. The tape will help the wood worker to make a quick adjustment of the screw and nut assemblies along the continuous dovetail groove 32 of the guide pieces.

It should now be apparent that a simple guide means for being able to straighten and square the edges of a board which has two curved, uneven edges and so as to be straightened and square cut can be had on one uneven side edge of the board from the other side uneven edge. This replaces the ordinary current way of nailing a straight edge wood rip guide on double, crooked, curved or uneven edged boards 16. Once the board has been put into the guide and passed through the table saw, the one board edge will have been straightened and squared with but a simple single cut. Time need not be taken to remove a temporary wood piece that cabinetmaker would have nailed to the board 16 and thereafter to have to fill the nail holes left in the board. For given same length and similar crooked boards, an adjustment of the assemblies will not often be necessary from one uneven board to another but if necessary can be done to accommodate the individual board. An effective straight line cut will thus have been provided on the one side edge from which a straight cut may be made upon the other uneven side edge of the board. Once there is a straight cut upon the one side edge of the board, the board itself will have the straight cut for squaring of the other uneven edge and there is no need for further use of the guide for the final straightening and squaring of the board as with a jointer tool.

While various changes may be made in the detail construction, it shall be understood that such changes shall be within the spirit and scope of the present invention as defined by the appended claims.

What is claimed is:

1. A straight edge ripping guide for use with boards having two visible uneven side edges to be cut off comprising an elongated guide piece with forward and rear ends and having a straight side face extending therefrom adapted to abut a saw fence of a saw table when the guide with a board together are pushed along the saw fence of the saw table to rip cut the board and having an opposite parallel side face with a continuous groove, laterally-extending projection assemblies adapted to engage spaced high points of one uneven side edge of the board and adjustable along the groove for alignment therewith and a push stop extending laterally from the forward end of the guide piece for receiving one end of the board upon the high points of the one uneven side edge of the board being placed against the laterally-extending projections of the guide piece and upon the guide piece and board being pushed together along the saw fence of the saw table thereby to effect a straight and square ripping cut upon the other uneven side edge of the board.

2. A straight edge ripping guide for use with boards having two visible uneven side edges to be cut off as defined in claim 1 and said push stop having pin points for receiving the one end of the board thereby to retain the board against lateral and upward displacement from the opposite side face of the guide piece while the sawing operation is being performed.

3. A straight edge ripping guide for use with boards having two visible uneven side edges to be cut off as defined in claim 2 and said laterally-extending projections being longitudinally-spaced from one another and respectively lying adjacent to the forward and rear ends of the guide piece to provide an imaginary line between the projections from which a first cut will be effected on an uneven side edge of the board and the laterally-extending projection adjacent to the rear end of the guide piece having a pin point engageable with the high point of the engageable uneven side of the board to further retain the board against upward displacement from the guide piece.

4. A straight edge ripping guide for use with boards having two visible uneven side edges to be cut off as defined in claims 1, 2 or 3 and said groove in said parallel opposite side face being a continuous dovetail groove extending longitudinally therethrough and said laterally-extending projections being releasably secured to said dovetail groove for adjustment along the groove to align the projections with high points on the one uneven edge of the board.

5. A straight edge ripping guide for use with boards having two visible uneven side edges to be cut off as defined in claim 1, 2 or 3 and said guide being made up of main and extension pieces detachably connected together.

6. A straight edge ripping guide for use with boards having two visible uneven side edges to be cut off as defined in claim 5 said guide pieces being hollow with square section openings extending therethrough, means for detachably connecting the pieces together comprising elongated square section blocks adapted to extend between the square section openings of the guide pieces and pin spring latches on the guide pieces for engagement with the elongated blocks.

7. A straight edge ripping guide for use with boards having two visible uneven side edges to be cut off as defined in claim 6 and said laterally-extending push stop having means for detachably connecting the push stop to the square section opening at the forward end of the guide pieces including a square section block and a spring latch pin on the guide piece at the forward end for engagement with the push stop square section block.

* * * * *